United States Patent [19]

Morin et al.

[11] 4,204,604

[45] May 27, 1980

[54] CONTAINER WITH CLOSURE AND CLOSURE REMOVAL MEANS

[75] Inventors: Marius J. Morin, Westlake Village; Colin J. Nichols, Burlingame; Myron R. Prouty, Oakland, all of Calif.

[73] Assignee: Cutter Laboratories, Inc., Berkeley, Calif.

[21] Appl. No.: 34,827

[22] Filed: Apr. 30, 1979

[51] Int. Cl.[2] ..... B65D 41/32

[52] U.S. Cl. ..... 215/257; 215/249; 220/277

[58] Field of Search ..... 215/250, 257, 249, 253, 215/32; 220/267, 277

[56] References Cited

U.S. PATENT DOCUMENTS

| | | | |
|---|---|---|---|
| 2,977,014 | 3/1961 | Kock | 215/32 X |
| 3,025,989 | 3/1962 | Williams | 215/257 |
| 3,266,658 | 8/1966 | Meissner | 220/277 |
| 3,784,045 | 1/1974 | Komendowski | 220/277 |
| 3,950,917 | 4/1976 | Choksi et al. | 215/250 X |

*Primary Examiner*—Donald F. Norton

*Attorney, Agent, or Firm*—Robert E. Allen; James A. Giblin; Bertram Bradley

[57] ABSTRACT

An improvement in a closure system for containers in which a cap member sealed at its base to an annular flange about the neck of the container is removeable by a cutting ring. The cap includes an upwardly projecting brim at the base separated from the side wall of the cap to provide an annular groove. The groove has at least one tapered recess. The cutting ring which can be positioned around the side wall of the cap has at least one depending tab with an inwardly directed sharpened projection. Normally, the tab rests in the recess of the groove. Upon rotation of the cutting ring, the tab is forced inwardly causing the sharpened projection to sever the side wall of the closure.

9 Claims, 11 Drawing Figures

CONTAINER WITH CLOSURE AND CLOSURE REMOVAL MEANS

BACKGROUND OF THE INVENTION

1. Field

This invention relates to a closure system for containers and more specifically a closure system on a container for medical liquid having an outer closure removeable by a cutting ring associated therewith.

2. Prior Art

Sterile medical liquids can be placed in thermoplastic containers and maintained in a bacteria-free condition prior to their use for irrigation of wounds or interior body cavities or for intravenous administration. Such containers generally have inner closures hermetically sealing off the contents of the container. Prior to use, however, the outer surfaces of these inner closures must be maintained in a sterile condition to avoid bacterial contamination when entry is made via the inner closures to deliver the sterile liquid. This can be accomplished by enclosing the inner closure with an outer closure which is sealed to the neck of the container. Outer closures can be removed by several means such as removal of a tear strip as disclosed in U.S. Pat. No. 3,394,831 or more recently by fracturing a line of weakness in the outer closure by stress imposed with a threaded jacking ring engaging the outer closure as disclosed in U.S. Pat. Nos. 3,923,183 and 3,945,525 for example. Such means for removing outer closures requires a degree of strength to effect rupture of the weakened zones which renders it difficult for certain medical personnel to use these closures.

Another approach to removing a plastic closure is by the use of cutting rings. In U.S. Pat. No. 3,266,658, there is disclosed a plastic container which is blow molded into a mold which contains a rigid ring with three cutting teeth projecting inwardly on the ring. Twisting the ring causes the teeth to sever the plastic circumferentially to provide an opening into the container. Such an approach would not be practicable in the manufacture of plastic containers having sterile liquids retained therein by inner closures. U.S. Pat. No. 3,591,031 shows a cutting ring fitted on the neck of a container which, in order to sever the neck portion, the ring would have to be squeezed while rotating it. This can be an awkward operation and one which may lead to non-uniform penetration of the plastic. In the arrangement in U.S. Pat. No. 3,784,045, while providing a more positive force on the cutting blade for severing the neck on a container, both the cutting ring and neck of the container must be threaded for the cutting action to take place.

SUMMARY OF THE INVENTION

The improvement in a cutting ring and closure for plastic containers of the present invention, whereas they are useful on any container for gaining access to the contents therein as in the food, soft drink, chemical industries, etc., the improvement is particularly useful on containers for medical liquids which have inner closures sealing the contents therein.

The cutting ring comprises a rigid circular band to which one or more tabs is attached in a depending fashion generally parallel to the axis of the ring. A sharpened projection or cutting tooth lies on the inner surface of the tab near the unattached end of the tab. The ring is made of a material which is rather rigid and which can retain sharpened edges on the cutting tooth and yet be somewhat resilient so that the tab can be made to deflect slightly. Typical of such a material is SAN (styrene-acrylonitrile). The band, in a preferred form of the ring, extends beyond the point where the tab (or tabs) is attached so that the lower edge of the band is substantially in the same plane as the lower edge of the tab.

The closure which is intended to be removed by the cutting ring comprises a cap member having a top wall and a generally cylindrical side wall terminating in a base which is adapted for sealing hermetically to the neck of a plastic container. A brim projects upwardly from the base spaced from the side wall so as to provide a groove between the brim and the side wall. A tapered recess in the brim provides space into which a tab may nest when the cutting ring is placed around the side wall of the closure. If more than one tab is present on the cutting ring, there are an equivalent number of brim recesses appropriately spaced so as to accommodate each tab. The closure is preferably made of the same thermoplastic material as that of the container and should be capable of being cut by the cutting tooth on the tab of the cutting ring. Generally, polyolefins are most suitable. Preferably the side wall of the closure is rather rigid with a narrow circumferential area having a cross-section somewhat thinner than that of the rest of the side wall. This area of reduced thickness is located so that it is adjacent to the cutting tooth when the cutting ring is properly positioned around the closure.

The cutting ring normally rests in a position about the closure where the tab (or tabs) nests in the brim recess. When one desires to remove that portion of the closure above the base, the cutting ring is rotated whereby the tab (or tabs) are forced out from the brim recess(es) and into the groove between the brim and side wall. This action effectively forces the cutting tooth through the side wall to sever it from the base. This combination of cutting ring and closure has an advantage over those of the prior art which utilize threaded components in that the cutting ring of this invention can be rotated in either direction to sever the closure. Threaded jacking rings or cutting rings can only function as intended when they are rotated in one direction only.

A better understanding of the advantages of the invention will become apparent from the following description of some preferred embodiments and as shown in the drawings.

DETAILED DESCRIPTION OF PREFERRED EMBODIMENTS

Figure 1:
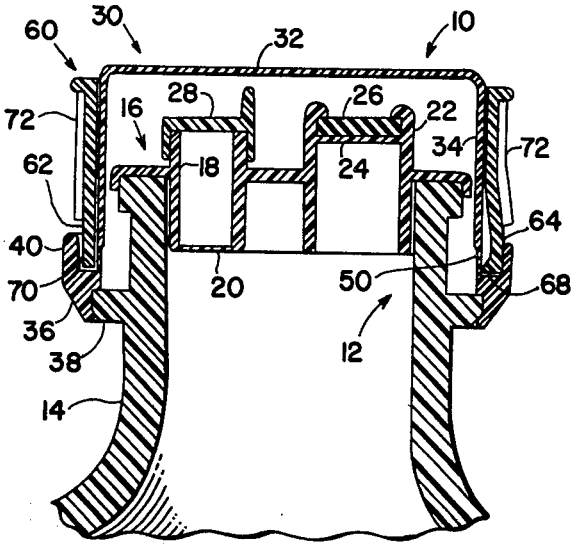
FIG. 1 is a fragmentary elevational view in cross section showing the upper part of a liquid container with a closure system embodying the present invention.

Referring to the drawings, FIG. 1 shows a closure system 10 for a dispensing outlet 12 of a thermoplastic container whose neck portion 14 only is illustrated. For use in storing and dispensing intravenous solutions, the top of the neck is typically sealed off with an inner closure 16, generally with a spike entry port 18 having a pierceable membrane 20 and an additive port 22 having a membrane 24 and a resealable pad 26. Port 18 may be closed with a cover 28.

Figure 2:
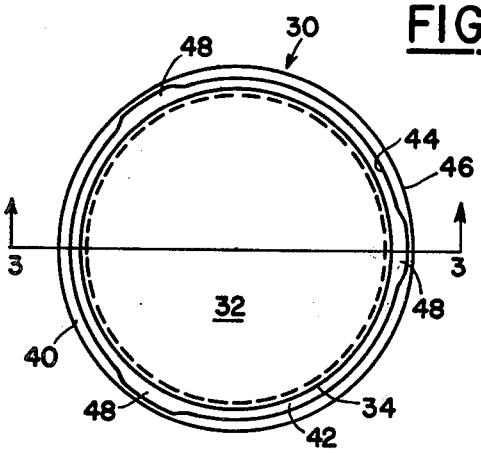
FIG. 2 is a top plan view of the closure shown in FIG. 1.
Figure 3:
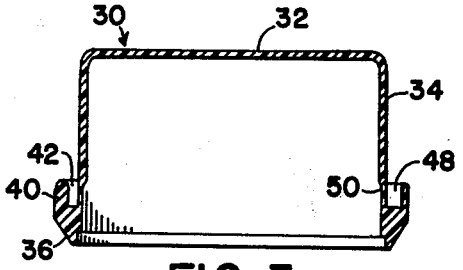
FIG. 3 is a view in section taken along the line 3—3 of FIG. 2.
Figure 6:
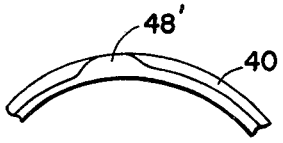
FIG. 6 is a fragmentary top plan view of a modification of the closure.

Surrounding the inner closure 16 is an outer closure 30 with a top wall 32, a side wall 34, and a base portion 36 sealed to an annular flange 38 on neck 14. Closure 30 is made of thermoplastic material, preferably the same as that of the container so that a good hermetic seal can be achieved between the base 36 and flange 38. Extending upwardly from base 36 and outward from side wall 34 is a brim 40 which forms a groove 42. In at least one position the inner side wall 44 of brim 40 tapers towards the outer wall 46 to form a recess or cavity 48 wherein the groove 42 is somewhat wider. In a preferred embodiment 30 shown in FIG. 2, there are three such cavities. However, other embodiments of the closure having two or more than three cavities are also suitable. The cavity may also extend all the way through brim 40 such as cavity 48′ shown in FIG. 6. The side wall 34 of closure 30 may be of uniform thickness but preferably is thinner in the area 50 adjacent groove 42.

Figure 4:
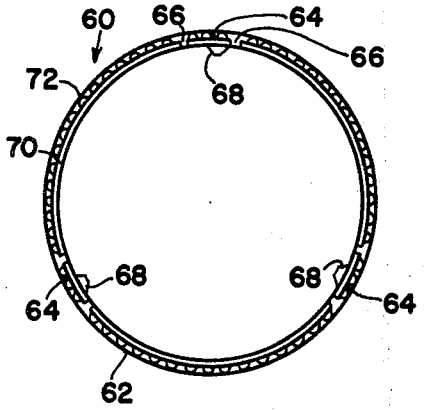
FIG. 4 is a bottom plan view of the cutting ring shown in FIG. 1.
Figure 5:
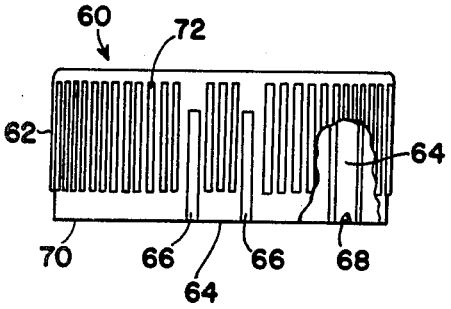
FIG. 5 is an elevational view partly in section of the cutting ring in FIG. 4.

The portion of the outer closure 30 above base 36 can be severed by a cutting ring 60 whose details are shown in FIGS. 1, 4 and 5. The embodiment of ring 60 has a circular wall 62 which has three tabs 64 formed by slots 66 extending part way up in wall 62. At the lower or unattached end of each tab 64 extending inwardly from the inner surface of the tab is a sharpened projection or tooth 68. The inside diameter of ring 60 is slightly larger than the outer diameter of closure 30 so that ring 60 can be positioned around side wall 34. The thickness of the wall 62 on ring 60 is slightly less than the width of groove 42. The width of cavity 48 is at least sufficient to allow the tab 64 with its tooth 68 to nest within cavity 48 when ring 60 is positioned so that its lower rim 70 rests in groove 42. In this position, tab 64 is bent slightly (as shown in FIG. 1). Ring 60 can be constructed of any material as long as the tab 64 is capable of bending. Typically it can be made of metal, a rigid plastic such as SAN (styrene-acrylonitrile), ABS (acrylonitrile-butadiene-styrene), or the like. Preferably it has a knurled outer surface provided by a series of ribs 72 for greater ease in rotating.

Although embodiment 60 has three tabs 64, cutting rings with one tab or two tabs or more than three tabs with sharpened teeth obviously are used with outer closures having a corresponding number of cavities 48 in brim 40. In embodiment 60, the teeth 68 are preferably positioned so that no single tooth is placed in exactly the same location on the tab, such as is shown in FIG. 4. However, this asymmetric placement is not critical but is generally preferred for cutting rings having more than one tab.

When it is desired to gain access to the contents of the container, cutting ring 60 is rotated in either direction. This action forces the tabs 64 out of cavities 48 and into groove 42 causing teeth 68 to penetrate through and sever side wall 34 of closure 30. With the three tab construction of embodiment 60, the ring requires no more than a one-third turn. The portion of closure 30 which is severed remains within ring 60, held in place by teeth 68, so that the two parts can be removed and discarded together.

Figure 7:
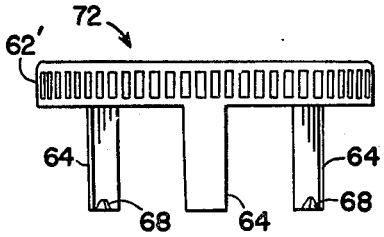
FIG. 7 is an elevational view of another version of the cutting ring.

Another variation 72 of a cutting ring as shown in FIG. 7 is similar to cutting ring 60 except that the wall 62′ does not extend beyond the point of attachment of the tabs 64. Its operation is similar to that described for ring 60.

Figure 8:
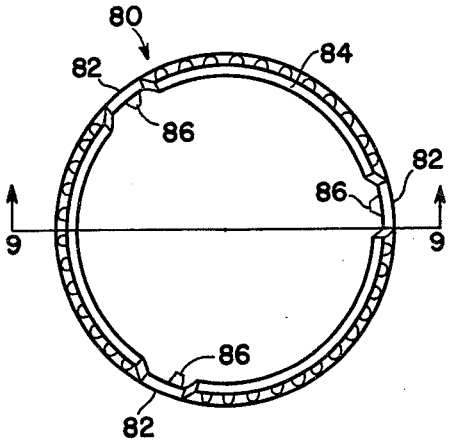
FIG. 8 is a bottom plan view of still another version of the cutting ring.
Figure 9:
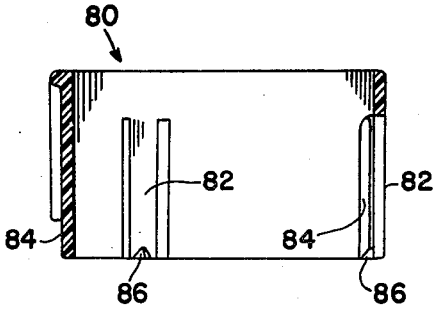
FIG. 9 is a view in section taken along the line 9—9 of FIG. 8.
Figure 10:
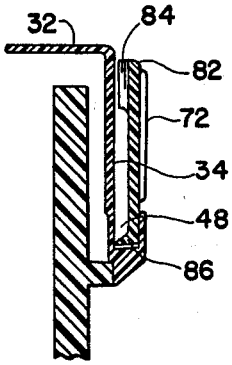
FIG. 10 is fragmentary elevational view in section of the cutting ring of FIG. 8 in relation to the closure of FIG. 2.

Another preferred embodiment of a cutting ring is illustrated in FIGS. 8 and 9. Here cutting ring 80 has tabs 82 offset outwardly from side wall 84 so that teeth 86 project inwardly essentially no farther than the inner surface of wall 84. As a result, when ring 80 is seated around closure 30, tab 82 rests in cavity 48 in an unbent condition as shown in FIG. 10. The advantage of this embodiment is that the ring can be kept on the closure for prolonged periods of time prior to use without stressing the side wall of the closure with the teeth on the ring.

Figure 11:
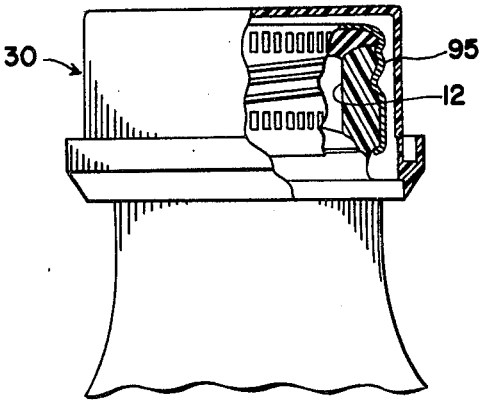
FIG. 11 is a fragmentary elevational view partly in section showing the upper part of a liquid container sealed by an inner closure and the outer closure of FIG. 2.

The combination of cutting ring and outer closure can be adapted to thermoplastic containers whose dispensing outlet is sealed with a cap, for example a screw cap 90, as shown in FIG. 11. This closure system is particularly useful for irrigation solution containers in which sterile inner closure surfaces can be assured.

Several examples of the cutting ring and outer closure for containers of the present invention have been disclosed in detail; however, these should be construed as illustrative only and the scope of the invention is intended to be limited only by the claims which follow.

We claim:

1. A container with a dispensing outlet, an inner closure hermetically sealing the outlet, an outer closure having a top wall and a side wall surrounding the outlet and with its base hermetically sealed to an annular abutment about the outlet, and a cutting ring disposed about the outer closure and adapted for severing a portion of the outer closure to expose the inner closure, wherein the improvement comprises:

the cutting ring having at least one deflectable tab at its periphery which extends in a direction generally parallel to the axis of the ring and with a sharpened projection on the inner surface of the tab, the outer closure having an upstanding brim at the base outboard of the side wall providing a groove, the brim having at least one nesting means for accommodating an outer end portion of the tab, whereby the cutting ring may be positioned about the outer closure so as to position the outer end portion of the tab in the nesting means but upon rotation of the cutting ring the tab is forced away from the nesting means and moves inwardly by pressure exerted on it from contact with the inner surface of the brim, thereby forcing the sharpened projection to penetrate and sever the side wall of the outer closure.

2. The container of claim 1 wherein the side wall of the outer closure has an area of reduced cross-section around its circumference adjacent to the sharpened projection on the tab when the cutting ring is positioned for use.

3. The container of claim 1 wherein there are three tabs spaced on the cutting ring and three nesting means correspondingly spaced in the brim of the outer closure.

4. The container of claim 1 wherein the cutting ring has sides extending substantially the same length as the length of the tab.

5. The container of claim 1 wherein the sharpened projection on the tab comprises a bevelled tooth having a flat lower surface perpendicular to the tab and located near the outer end portion of the tab.

6. The container of claim 1 wherein the nesting means comprises a slot cut into the brim at least one side of which tapers towards the inner surface of the brim.

7. The container of claim 1 wherein the nesting means comprises a cavity in the brim at least one side of which tapers towards the inner surface of the brim.

8. The container of claim 1 wherein the cutting ring comprises a band having three tabs offset outwardly from the band and whose sharpened projections extend inwardly substantially no farther than the inner surface of the band.

9. A container with a dispensing outlet, an outer closure having a top wall and a side wall surrounding the outlet and with its base hermetically sealed to an annular abutment about the outlet, and a cutting ring disposed about the outer closure and adapted for severing a portion of the outer closure wherein the improvement comprises:

the cutting ring having at least one deflectable tab at its periphery which extends in a direction generally parallel to the axis of the ring and with a sharpened projection on the inner surface of the tab, the outer closure having an upstanding brim at the base outboard of the side wall providing a groove, the brim having at least one nesting means for accommodating an outer end portion of the tab, whereby the cutting ring may be positioned about the outer closure so as to position the outer end portion of the tab in the nesting means but upon rotation of the cutting ring the tab is forced away from the nesting means and moves inwardly by pressure exerted on it from contact with the inner surface of the brim, thereby forcing the sharpened projection to penetrate and sever the side wall of the outer closure.

* * * * *